US006340342B1

(12) United States Patent
Lee

(10) Patent No.: US 6,340,342 B1
(45) Date of Patent: Jan. 22, 2002

(54) MULTIPURPOSE EXERCISING APPARATUS

(76) Inventor: Jason Lee, 6Fl.-2, No. 666-8, Sec. 2, Chung Hua Rd., Taipei (TW)

( * ) Notice: Subject to any disclaimer, the term of this patent is extended or adjusted under 35 U.S.C. 154(b) by 0 days.

(21) Appl. No.: 09/390,776

(22) Filed: Sep. 7, 1999

(30) Foreign Application Priority Data

Jun. 16, 1999 (TW) ..... 88209967 U

(51) Int. Cl.[7] ..... A63B 26/00
(52) U.S. Cl. ..... 482/142; 482/79; 482/80
(58) Field of Search ..... 482/79–80, 91, 482/96, 142, 907, 908

(56) References Cited

U.S. PATENT DOCUMENTS 4,768,775 A * 9/1988 Marshall ..... 482/73
5,039,092 A * 8/1991 Olschansky et al. ..... 482/130
5,277,684 A * 1/1994 Harris ..... 482/130
5,462,510 A * 10/1995 Ish, III ..... 482/142
5,833,535 A * 11/1998 Williams ..... 482/80
5,882,283 A * 3/1999 Stevens ..... 482/104

* cited by examiner

*Primary Examiner*—Mickey Yu
*Assistant Examiner*—Lou Baker Amerson
(74) *Attorney, Agent, or Firm*—Bacon & Thomas, PLLC

(57) ABSTRACT

A multipurpose exercising apparatus. The apparatus includes a mattress unit formed of a back mattress and a seat mattress, a rack, and a damping unit, wherein the relative angle between the back mattress and the seat mattress being adjustable. The position of the mattress unit is adjustable relative to the rack. The damping unit includes at least one actuating bar, one linking mechanism and one damping force source. By changing the position and/or direction of the mattress, the angle between the back mattress and the seat mattress, and/or the position of the actuating bar, the user can operate the exercising apparatus to exercise different parts of the body in different exercising positions.

6 Claims, 9 Drawing Sheets

MULTIPURPOSE EXERCISING APPARATUS

BACKGROUND OF THE INVENTION

1. Field of the Invention

The present invention relates to an exercising apparatus for physical exercises, and more particularly to a multipurpose exercising apparatus.

2. Description of the Related Art

Conventional exercising apparatus are commonly heavy, and designed for exercising a particular part of the body only. There are also known universal exercising apparatus for exercising different parts of the body. However, because these universal exercising apparatus are a combination of different exercising units, they are commonly heavy and expensive, and not suitable for home use.

SUMMARY OF THE INVENTION

It is one object of the present invention to provide an exercising apparatus, which is lightweight, and practical for home use to exercise different muscles of the body. It is another object of the present invention to provide a multipurpose exercising apparatus, which has a simple damping structure, that enables the user to exercise the body in different postures. To achieve these and other objects of the present invention, there is provided a multipurpose exercising apparatus, which comprises a mattress unit formed of a back mattress and a seat mattress, a rack, and a damping unit. The mattress unit comprises an adjustment mechanism for adjusting the relative angle between the back mattress and the seat mattress, and a coupling mechanism for securing the mattress unit to the rack, enabling the mattress unit to be moved on the rack. Preferably a steering mechanism is provided for enabling the mattress unit to be changed to the desired direction. The damping unit is mounted on the rack at one end, comprising at least one actuating bar, a linking mechanism, and a damping force source. The user can change the position of the actuating bar relative to the damping force source. By means of changing the position and/or direction of the mattress, the angle between the back mattress and the seat mattress, and/or the position of the actuating bar, the user can operate the exercising apparatus to exercise different parts of the body in different exercising positions.

FIGS. from 3 through 10 illustrate different application examples of the first embodiment of the present invention.

Figure 11:
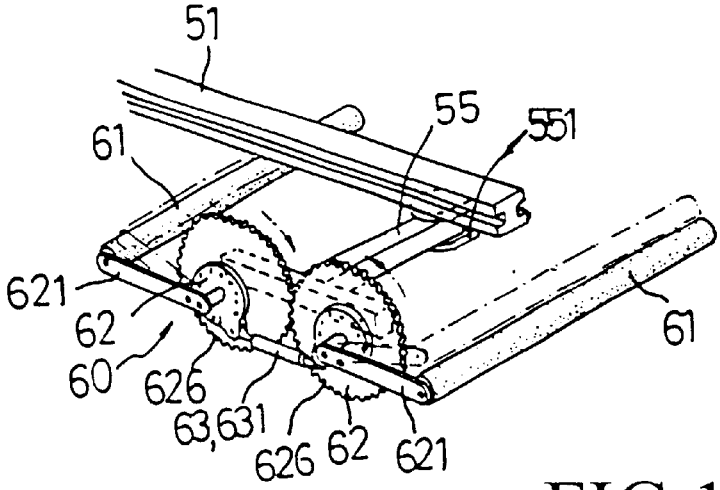

FIG. 11 shows the damping unit of the second embodiment of the present invention set at the first mode.

Figure 12:
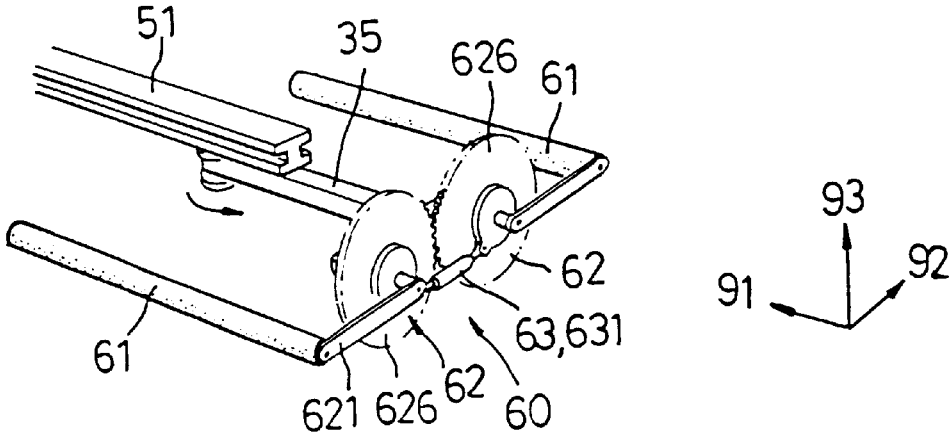

FIG. 12 shows the damping unit of the second embodiment of the present invention set at the second mode.

Figure 13:
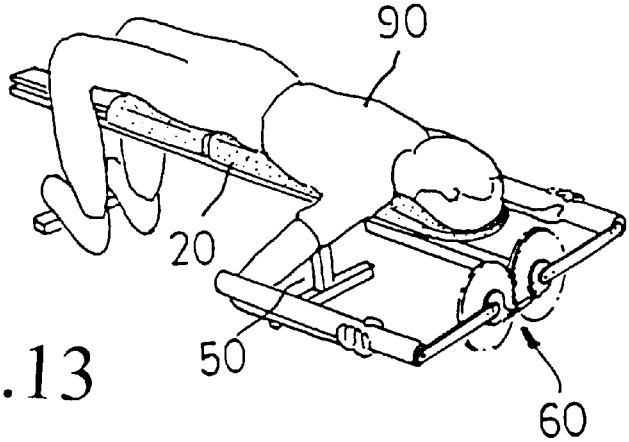

FIG. 13 illustrates an application example of the second embodiment of the present invention.

Figure 14:
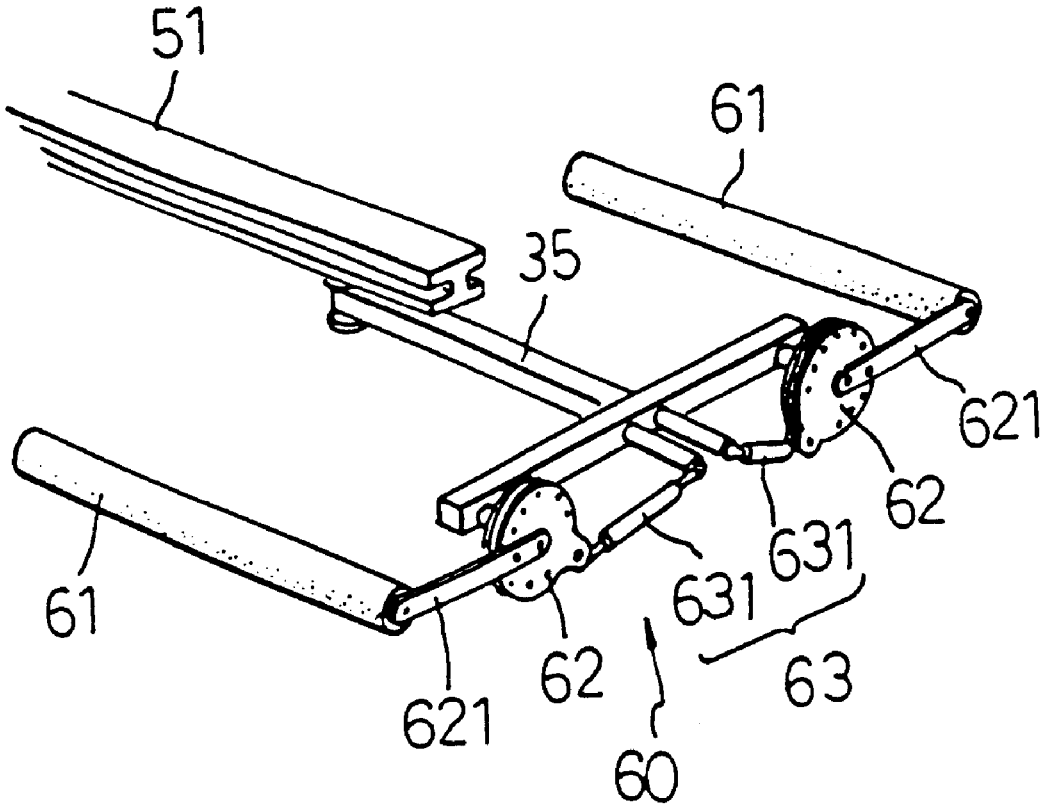

FIG. 14 shows the damping unit of the second embodiment of the present invention.

DETAILED DESCRIPTION OF THE PREFERRED EMBODIMENT

Figure 1:
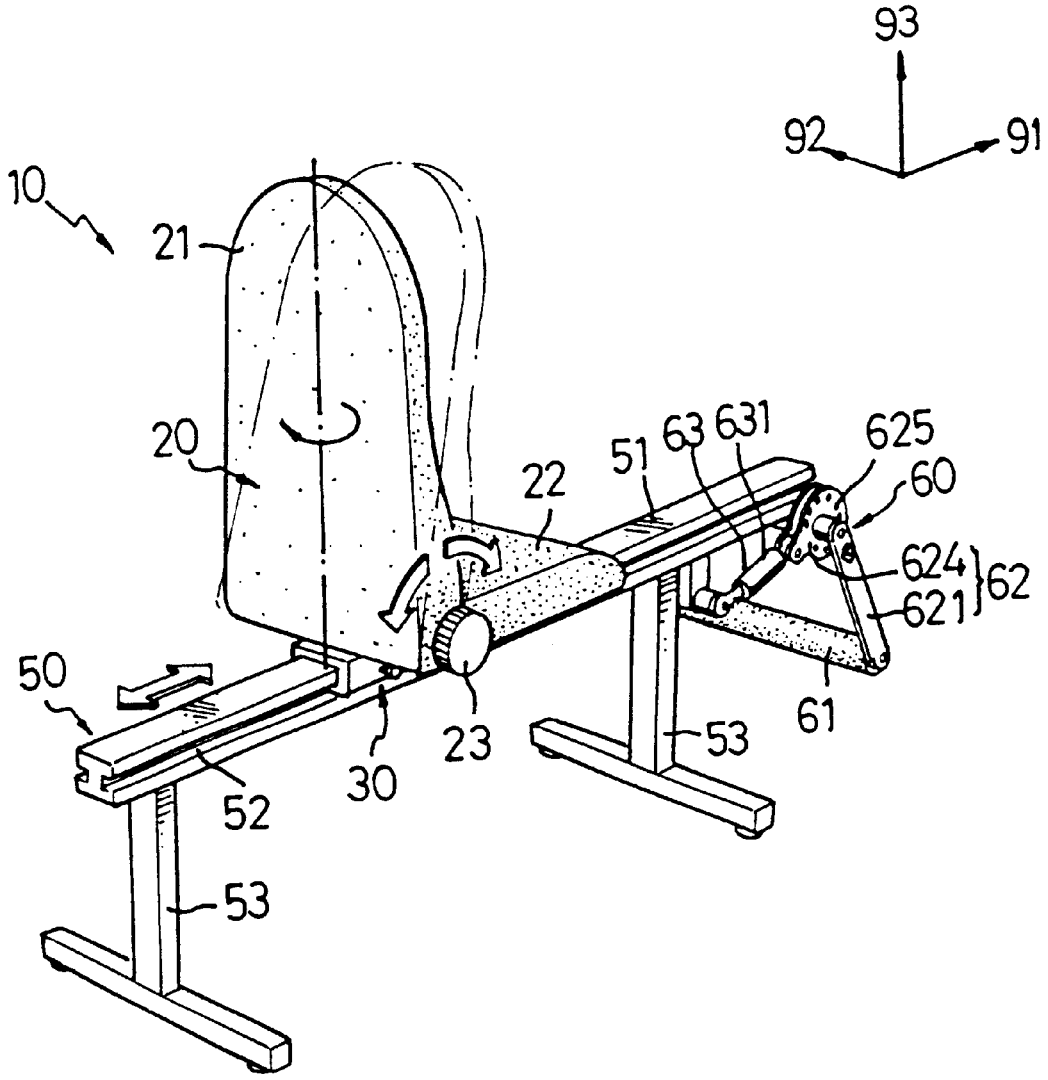
FIG. 1 is a perspective view of a multipurpose exercising apparatus of the first embodiment of the present invention.
Figure 2:
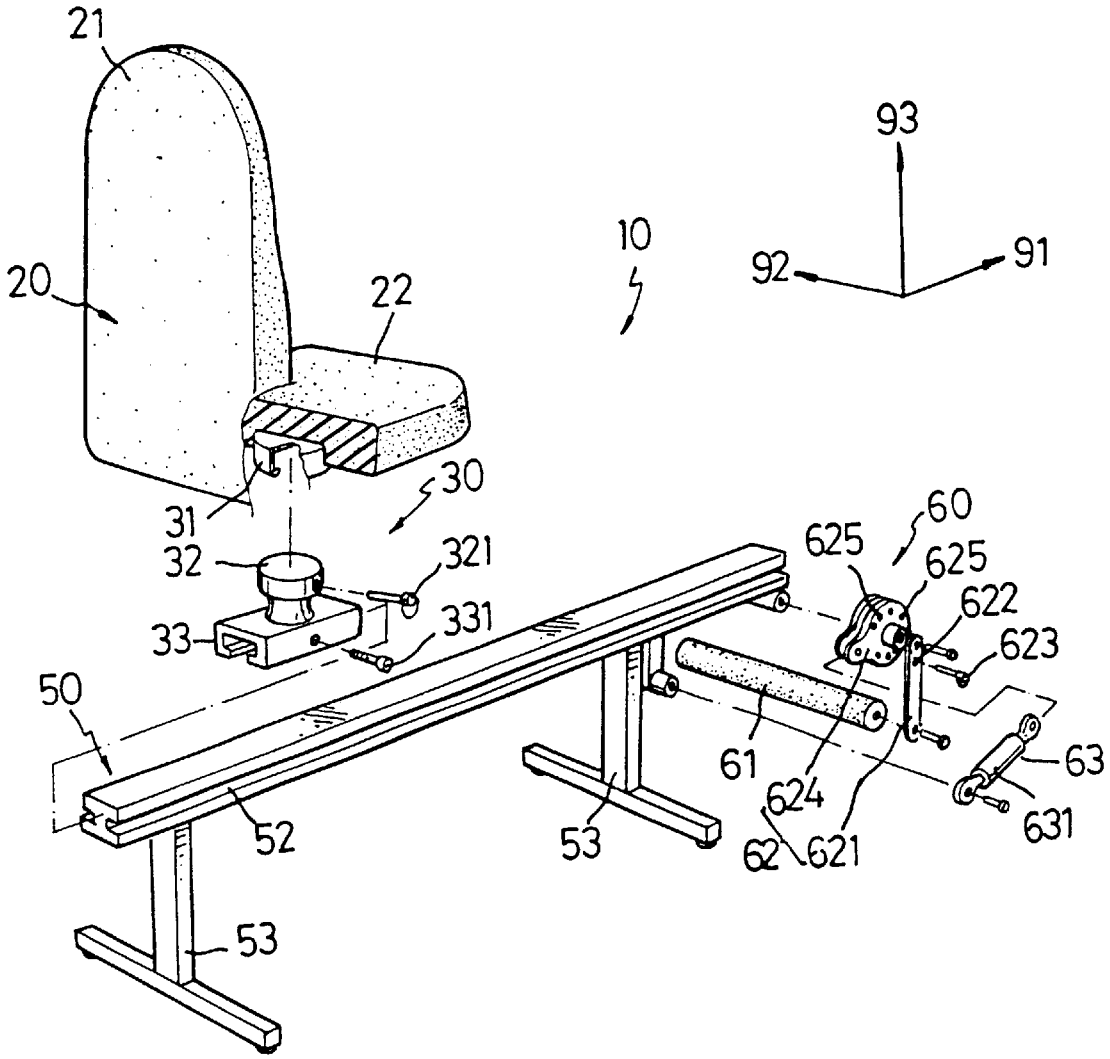
FIG. 2 is an exploded view of the first embodiment of the present invention.

Referring to FIGS. 1 and 2, a multipurpose exercising apparatus 10 is designed to be placed on the floor for exercising the body, comprising a mattress unit 20, a rack 50, and a damping unit 60.

The rack 50 comprises a main rod member 51 extended in X-axis direction 91, and two stands 53 which support the main rod member 51 in a horizontal position above the floor. The main rod member 51 defines a longitudinal sliding track 52.

The mattress unit 20 comprises a back mattress 21, a seat mattress 22, an adjustment mechanism 23, and a coupling mechanism 30. The back mattress 21 and the seat mattress 22 are pivoted to each other. The adjustment mechanism 23 is controlled to adjust the angle between the back mattress 21 and the seat mattress 22. The adjustment mechanism 23 can be achieved by any of a variety of known designs. Because the adjustment mechanism 23 is not within the scope of the invention claimed, it is neither described in detail nor shown in the annexed drawings.

The coupling mechanism 30 is provided at the bottom side of the seat mattress 22 for coupling the mattress unit 20 to the main rod member 51. According to the present preferred embodiment, the coupling mechanism 30 comprises a steering mechanism formed of a socket 31 and a support 32, and a slide 33. The socket 31 is fixedly fastened to the seat mattress 22 at the bottom. The support 32 has one end fixedly connected to the slide 33, and an opposite end coupled to the socket 31 to support the socket 31, enabling the socket 31 to be rotated on the support 32. By means of the socket 31 and the swivel member 32, the mattress unit 20 can be turned about Z-axis 93. A lock pin 321 may be installed to lock the socket 31 and the support 32, preventing a relative rotation motion between the socket 31 and the support 32. The slide 33 is coupled to the main rod member 50, and moved along the sliding track 52. A lock pin 331 may be installed to lock the slide 33 and the main rod member 50, preventing movement of the slide 33 relative to the main rod member 50.

The damping unit 60 is mounted on one end of the main rod member 50. According to the present preferred embodiment, the damping unit 60 comprises an actuating bar 61, a linking mechanism 62, and a damping force source 63. The linking mechanism 62 comprises a link 621, and a connector 624. The link 621 has one end coupled to the actuating bar 61, and an opposite end pivoted to the connector 624. The connector 624 comprises a plurality of adjustment holes 625 arranged in a circle. The link 621 has a locating hole 622 selectively connected to one adjustment holes 625 at the connector 624 by a locating member 623. By inserting the locating member 623 through the locating hole 622 at the link 621 into any one of the adjustment holes 625 at the connector 624, the link 621 is pivoted to the connector 624. By shifting the locating member 623 from one adjustment hole 624 to another, the relative coupling position between the link 621 and the connector 624 is changed, and the position of the actuating bar 61 is relatively changed. Because the two opposite ends of the linking mechanism 62 are respectively coupled to the actuating bar 61 and the damping force source 63, a damping force is produced when applying a force to the actuating bar 61. The actuating bar 61 is disposed in parallel to Y-axis direction 92, which is perpendicular to X-axis direction 91. The damping force source 63 has one end coupled to the rack 50, and an opposite end coupled to the linking mechanism 62. The damping force source 63 simply comprises an independent damping device 631. The damping device 631 can be a piston type damping device, spring, elastic cord, weight, magnetic force generator, etc. An adjustable damping device may be used, for example, the Resistance Device of Taiwan Patent Application No. 87218860. (equivalent U.S. patent application Ser. No. 09/238,499), which was invented by the present inventor.

Referring to FIGS. from 3 through 10, the user can adjust the position of the mattress unit 20 on the main rod member 51, rotate the mattress unit 20, adjust the relative angle between the back mattress 21 and the seat mattress 22, and/or adjust the position of the actuating bar 61, so as to perform different exercising modes.

Figure 3:
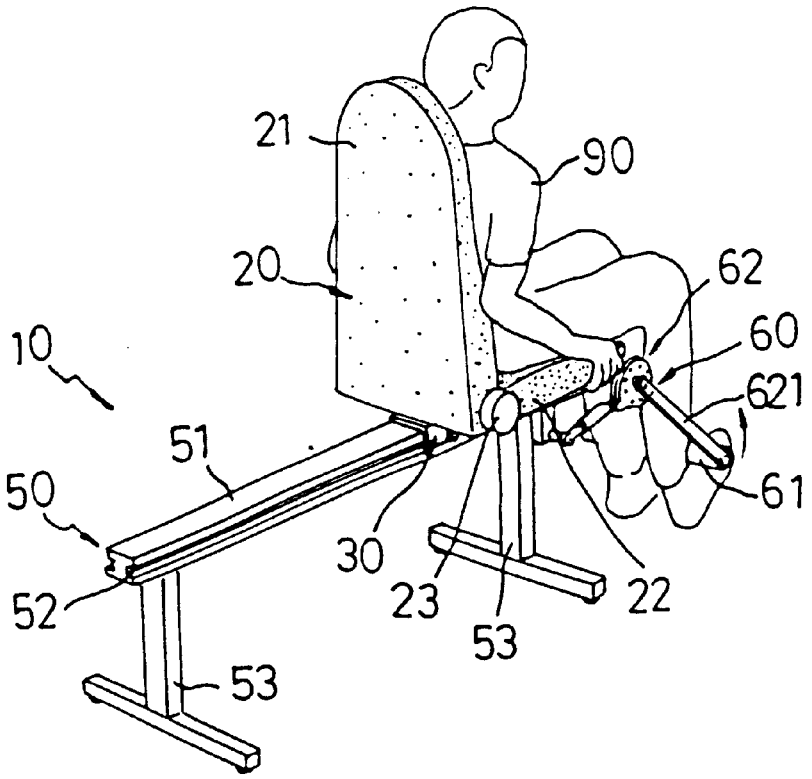
Figure 4:
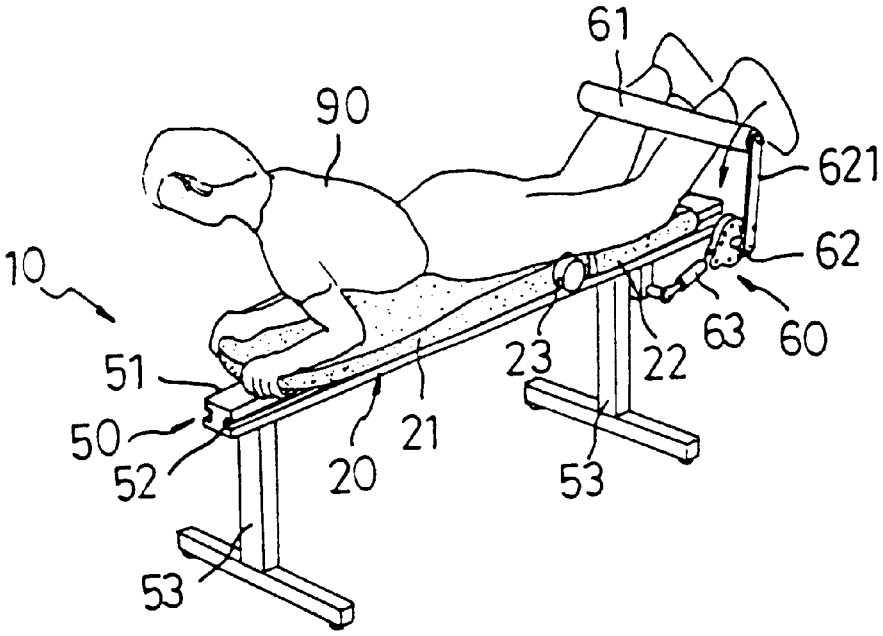
Figure 5:
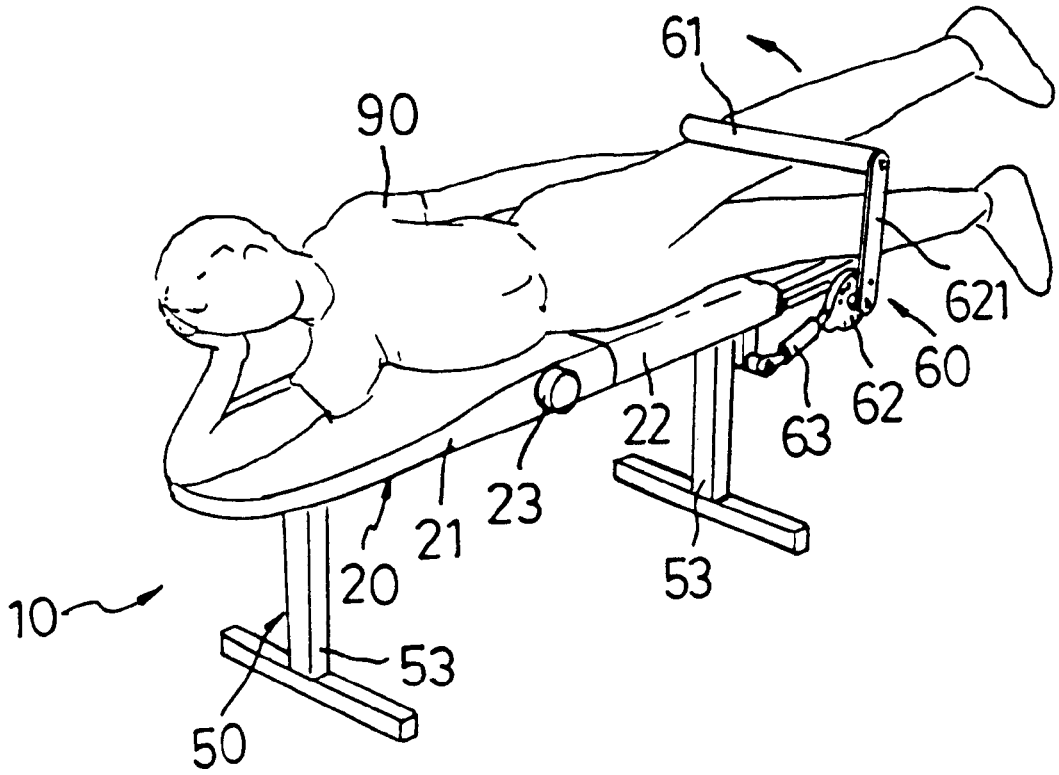
Figure 6:
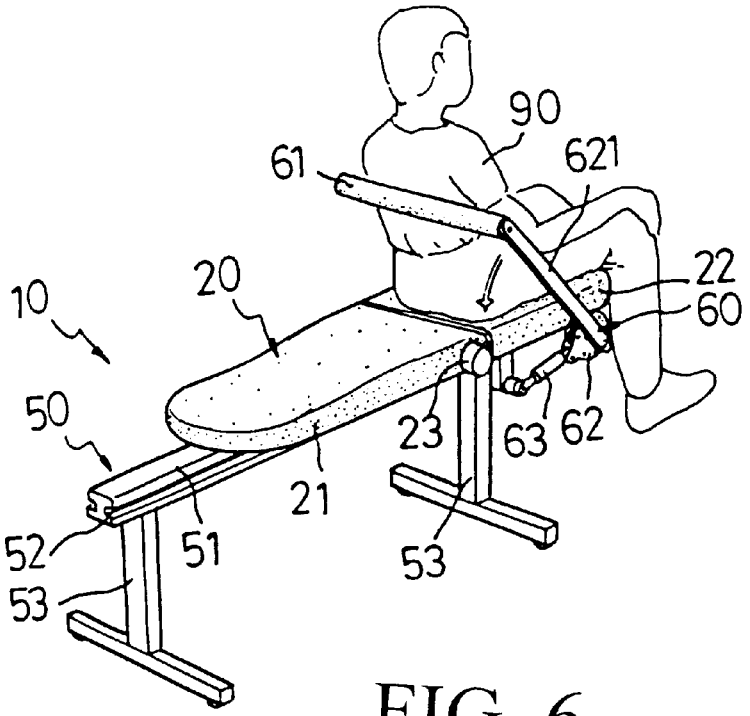
Figure 7:
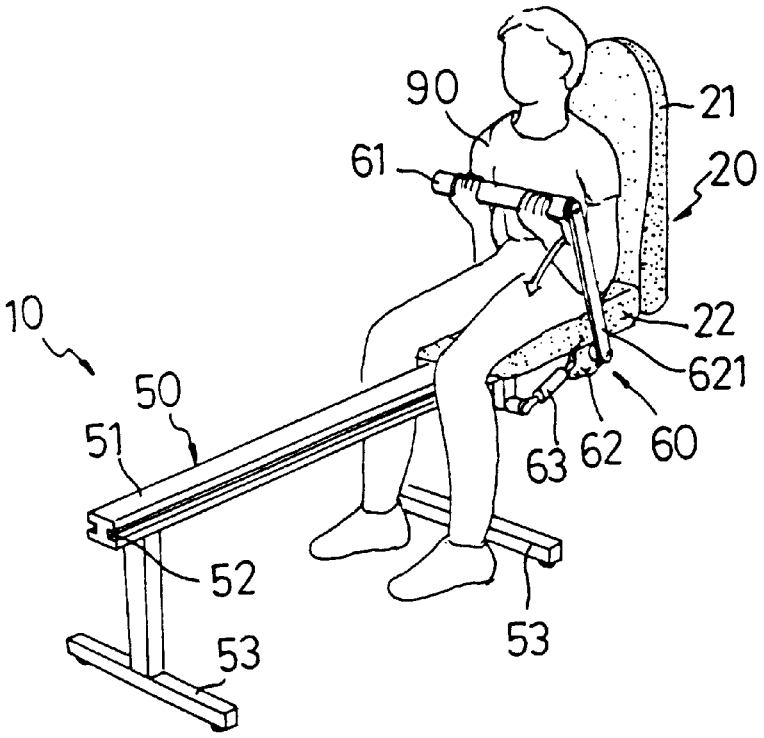
Figure 8:
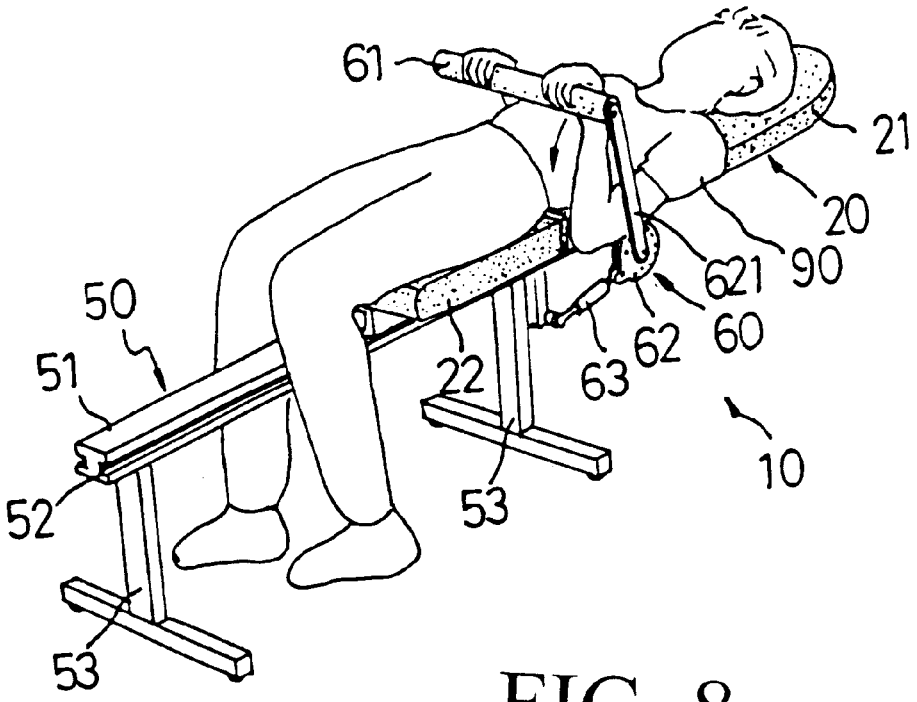
Figure 9:
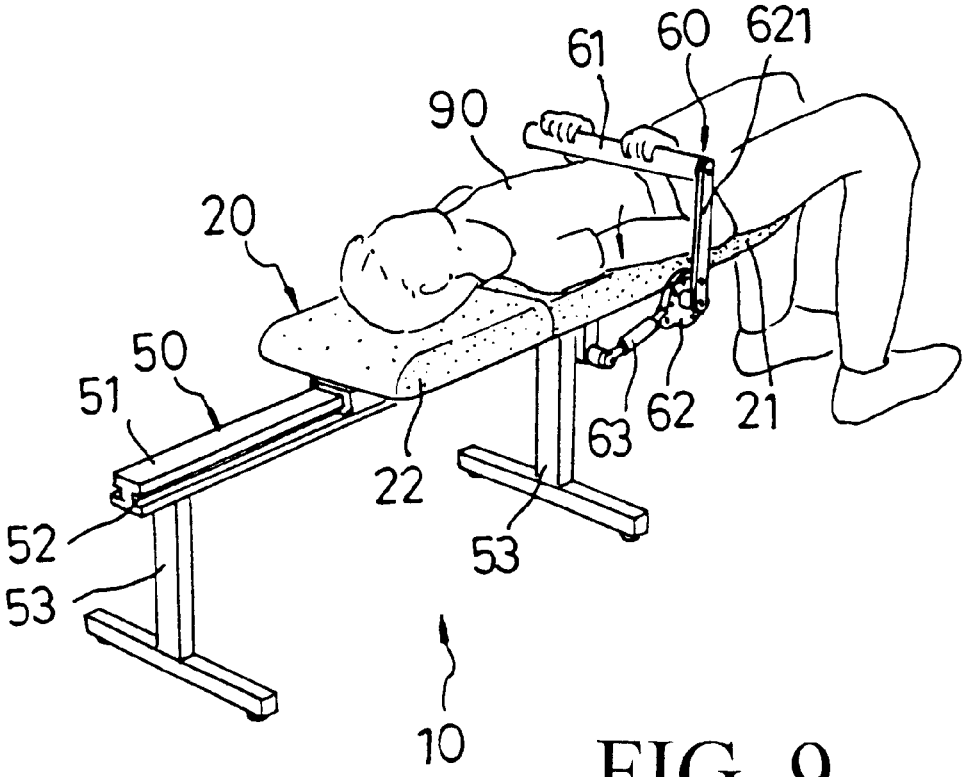
Figure 10:
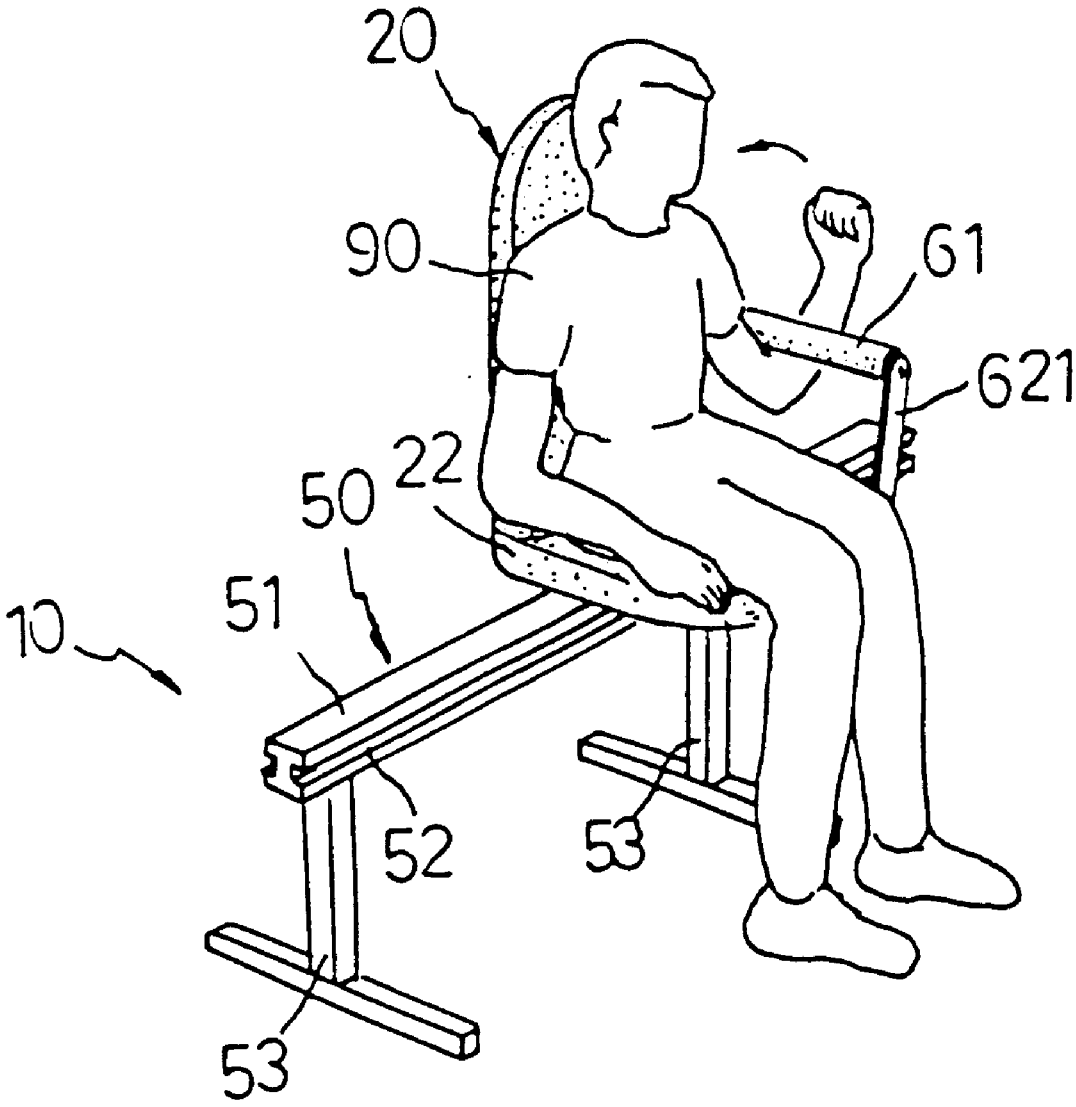

In FIG. 3, the user 90 operates the multipurpose exercising apparatus in a sitting position to raise the legs forwards In FIG. 4, the back mattress 21 is turned down and supported on the main rod member 51, and the user prostrates oneself on the back mattress 21 and the seat mattress 22, and bends the legs upwards. At this time, the position of the actuating bar 61 must be adjusted, enabling the actuating bar 61 to be lifted above the seat mattress 22. In FIG. 5, the user 90 lies the body in a horizontal position with one lateral side supported on the back mattress 21 and the seat mattress 22, and then raises the thigh of the leg at the upper side. In FIG. 6, the user 90 sits on the seat mattress 22, and the actuating bar 61 is adjusted to the back side of the user 90 above the back mattress 21, so that the user 90 can bend the trunk to stretch the back. In FIG. 7, the user 90 sits on the seat mattress 22, and the actuating bar 61 is adjusted to the front side of the user's chest, so that the user 90 can exercise the waist by bending the trunk. At this time, the mattress unit 20 is rotated through 180° relative to the position shown in FIG. 3. In FIG. 8, the user 90 lies the back on the seat mattress 22, and extends the lower arms outwards. In FIG. 9, the user 90 lies the back on the seat mattress 22, and bends the lower arms inwards. In FIG. 10, the mattress unit 20 is turned through 90° relative to the position shown in FIG. 3, and the user 90 sits on the seat mattress 22 to raise the lower arm. FIGS. 3 through 10 simply show certain application examples of the present invention to exercise muscles at different parts of the body.

FIG. 11 shows a second embodiment of the present invention. According to this alternate form, the damping unit 60 comprises a pair of actuating bars 61 and a pair of linking mechanisms 62, and a damping force source 63. The damping force source 63 is comprised of a damping device 631. The damping device 631 has two opposite ends respectively coupled the linking mechanisms 62 at one end, so that a damping force can be provided by the damping device 631 to the actuating bars 61. The rack 50 further comprises a swivel bar 55. The linking mechanisms 62 are fixedly connected to the swivel bar 55. Further, a pair of gear wheels 626 are respectively mounted on the linking mechanisms 62, and meshed with each other. The gear wheels 626 keep the linking mechanisms 62 in a symmetric status, preventing the damping device 631 from being twisted.

Referring to FIGS. 12 and 13 and FIG. 11 again, the damping unit 60 of the second embodiment of the present invention can be alternatively adjusted between the first mode shown in FIG. 11, and the second mode shown in FIG. 12. When in the first mode, the user can operate the multipurpose exercising apparatus in same manner as the aforesaid first embodiment, however in this case, only one actuating bar 61 (the actuating bar 61 at the right side shown in FIG. 11) is operated. When in the second mode, the swivel bar 55 is turned through 90° to change the position of the damping unit 60. At this time, the actuating bars 61 are disposed in parallel to X-axis direction 91. FIG. 13 shows the multipurpose exercising apparatus set in the second mode, the user performed a butterfly exercise.

FIG. 14 shows a third embodiment of the present invention. According to this embodiment, the damping force source 63 comprises two independent damping devices 631, each imparting a damping force to the corresponding actuating bar 61.

It is to be understood that the drawings are designed for purposes of illustration only, and are not intended for use as a definition of the limits and scope of the invention disclosed. For example, the stands 53 can be made folding collapsible; the rack 50 may be made having two main rod members 51; a different damping unit may be used; the link 621 can be of a telescopic design to fit different users or different exercising positions; and according to a different design of the coupling mechanism 30, the track 52 may be of different shape or eliminated.

What the invention claimed is:

1. A multipurpose exercising apparatus adapted to provide various exercising postures in order to exercise different muscle groups of the human body, one muscle group at a time, the apparatus comprising:

a rack, said rack comprising a main rod member linearly extending in a direction designated as X-axis direction, and at least one stand fastened to said main rod member and adapted to support said main rod member above a floor;

a mattress unit, said mattress unit comprising a back mattress, a seat mattress, an adjustment mechanism, and a coupling mechanism, said back mattress and said seat mattress pivotally connected to each other, said adjustment mechanism adjusts tilting of said back mattress from said seat mattress any angle between said back mattress and said seat mattress, said coupling mechanism fastened to said seat mattress at a bottom side thereof and coupled to the main rod member of said rack to enable said mattress unit to be moved on said rack in the X-axis and fixable in selected positions along the main rod member;

a damping unit mounted on said rack, said damping unit comprising a first actuating bar, a linking mechanism, and a damping force source device for providing resistance force, said linking mechanism having two opposite ends respectively coupled to said first actuating bar and said damping force source device adapted to enable the user to change positions of said first actuating bar with respect to said damping force source device and to receive a damping force when a force is applied to said first actuating bar;

said coupling mechanism comprises a rotating mechanism for enabling said mattress unit to be rotated to a desired direction;

said linking mechanism comprises a link and a connector, wherein said connector is pivotally connected to said rack, said link having one end thereof coupled to said first actuating bar, and an opposite end thereof pivotally connected to said connector, wherein a relative position of said link with respect to said connector can be changed to change position of said first actuating bar; and said damping force source device has one end thereof coupled to said rack, and an opposite end thereof coupled to said linking mechanism, such that upon actuation of force on said actuating bar, said damping force source device resists rotational motion of said connector.

2. The multipurpose exercising apparatus of claim 1, wherein said damping unit further comprises a second actuating bar positioned substantially parallel to said first actuating bar, and a corresponding second linking mechanism, said second linking mechanism having two opposite ends thereof respectively coupled to said second actuating bar and said damping force source device, so that a user may receive a damping force from said damping force source device when a force is applied to said second actuating bar.

3. The multipurpose exercising apparatus of claim 2, wherein said rack further comprises a swivel bar, said swivel bar supports said damping unit on said rack and is adapted to enable a user to change position of said damping unit by turning said swivel bar.

4. The multipurpose exercising apparatus of claim 3, wherein by turning said swivel bar to change the position of said damping unit enables the two actuated bars to be positioned parallel to one another in a direction perpendicular to the X-axis and designated as Y-axis.

5. The multipurpose exercising apparatus of claim 2, wherein said damping force source device comprises one single damping device coupled between the first and second linking mechanisms at one end thereof and adapted to impart a damping force to the two actuating bars.

6. The multipurpose exercising apparatus of claim 2, wherein said damping force source device comprises two damping devices.

* * * * *